US005511888A

United States Patent [19]

Beach

[11] Patent Number: 5,511,888

[45] Date of Patent: Apr. 30, 1996

[54] APPARATUS FOR RE-INKING THE RIBBON OF A PRINTER RIBBON CARTRIDGE

[75] Inventor: Grant W. Beach, Burien, Wash.

[73] Assignee: Mannesmann Tally Corporation, Kent, Wash.

[21] Appl. No.: 309,256

[22] Filed: Sep. 20, 1994

[51] Int. Cl.[6] ..... B41J 31/16

[52] U.S. Cl. ..... 400/197; 400/200

[58] Field of Search ..... 400/197, 200, 400/196, 196.1, 194, 191

[56] References Cited

U.S. PATENT DOCUMENTS

| | | | |
|---|---|---|---|
| 2,053,675 | 9/1936 | Moshier | 197/171 |
| 2,695,092 | 11/1954 | Pelton | 197/171 |
| 4,071,133 | 1/1978 | Scherrer et al. | 197/168 |
| 4,126,715 | 11/1978 | Schiffmacher et al. | 427/141 |
| 4,127,337 | 11/1978 | Bishop | 400/200 |
| 4,213,419 | 7/1980 | Nicholson | 118/670 |
| 4,526,487 | 7/1985 | Ikeda | 400/201 |
| 4,605,326 | 8/1986 | Everett, Jr. | 400/201 |
| 4,741,639 | 5/1988 | Fausto et al. | 400/197 |
| 4,948,275 | 8/1990 | Kuhn et al. | 400/200 |
| 5,005,997 | 4/1991 | Chung | 400/197 |
| 5,052,833 | 10/1991 | Huang et al. | 400/197 |
| 5,137,382 | 8/1992 | Miyajima | 400/202.4 |
| 5,207,519 | 5/1993 | Debreczenyi | 400/202.4 |

FOREIGN PATENT DOCUMENTS

| | | | |
|---|---|---|---|
| 3325917 | 2/1985 | Germany | 400/200 |
| 0049292 | 3/1983 | Japan | 400/200 |
| 4001287 | 1/1994 | WIPO | 400/197 |

*Primary Examiner*—Edgar S. Burr
*Assistant Examiner*—Anthony H. Nguyen
*Attorney, Agent, or Firm*—Christensen, O'Connor, Johnson & Kindness

[57] ABSTRACT

A printer ribbon cartridge (10) containing an internal re-inking mechanism (12) for re-inking the ribbon (14) housed in the cartridge is provided. The internal re-inking mechanism (12) comprises a drive assembly (30), pump (24), an eccentric (26), an ink reservoir (22), an ink feeding tube (34), a re-inking ring (30) and a transfer roller (38). As the ribbon (14) is threaded and propelled through the drive assembly (30), the drive assembly drives the pump (24) via the eccentric (26). The pump (24) pumps ink from the ink reservoir (22) to the re-inking ring (36) through the ink feeding tube (34). The ink is transferred from the re-inking ring (36) to the ribbon (14) via the transfer roller (38).

16 Claims, 2 Drawing Sheets

APPARATUS FOR RE-INKING THE RIBBON OF A PRINTER RIBBON CARTRIDGE

FIELD OF THE INVENTION

This invention generally relates to printer cartridges and in particular, to printer ribbon cartridges that include a ribbon re-inking mechanism.

BACKGROUND OF THE INVENTION

Printer ribbon cartridges for use with dot matrix and other types of impact computer printers are well known in the prior art. Many printer ribbon cartridges house an inked ribbon in the form of a continuous loop. In use, the ribbon is continuously withdrawn from one arm of the cartridge and returned to the opposite arm as a cartridge drive mechanism is rotated by a printer driver. Other printer ribbon cartridges transfer ribbon between a pair of reels as the printer operates. Printer ribbon cartridges are conventionally mounted in a printer so that an exposed length of ribbon between the arms of the cartridge passes between a printing surface and a print head. In the case of both line and character dot matrix computer printers, ink is transferred from the exposed length of the ribbon to the paper by the actuation of wires that form part of a print head. The ribbon is used until the ink on the ribbon is depleted and the print quality becomes unacceptable.

Acceptable print quality is determined by measuring the amount of ink deposited on a print media, e.g., paper. The light reflecting off a printed rectangle on the paper is used to measure the optical density of the print and is indicated in optical density units (O.D.U.). Using this technique, it is possible to determine when a ribbon has reached its minimum density level and is no longer producing acceptable print. The industry standard for minimum acceptable density is 0.50 O.D.U. Once the density approaches the minimum acceptable density, the printer cartridge or ribbon is usually replaced. Frequent replacement of the printer cartridge is costly and inconvenient. While the replacement of used ribbons with new ribbons is possible, this is time-consuming, messy, and requires disassembly of the printer cartridge. Thus, printer ribbon cartridges are usually disposed of, rather than recycled, even though the ribbon is still strong enough to be reused. In the past, cartridge life has been extended by re-inking the ribbon of a cartridge, without removal of the ribbon. Re-inking the ribbon allows the cartridge to continue producing acceptable print for a longer period of time. Thus, the cost and burden normally associated with replacing the cartridge or ribbon is greatly reduced.

Both internal and external re-inking mechanisms for re-inking ribbon are known in the prior art. An internal re-inking device normally comprises an ink supply combined with a mechanism for transferring the ink from the ink supply to the ribbon. In this regard, the mechanism normally comprises an absorbent element such as a foam ring or a wick that stores ink and a transfer roller that transfers the ink to the ribbon. If a foam ring is used, the ink supply is limited to the amount of ink the foam ring is capable of absorbing. When the ink supply is depleted, the foam ring is replaced or manually supplied with additional ink, which may require disassembly of the printer cartridge. A wick, on the other hand, absorbs ink from an internal source. However, as the ink supply diminishes, the wick tends to dry out. If the wick dries out before the ink supply is depleted, the remaining ink is wasted.

When an external re-inking device is used to re-ink the ribbon, the printer cartridge is usually removed from the computer printer and attached to the external re-inking device so that the ribbon is partially removed from the cartridge and threaded through the external re-inking device. The ink is applied to the ribbon either directly as it passes through an external ink supply or via a pump that applies ink to a transfer mechanism. In either case, an absorbent element such as a foam ring or wick is not utilized.

While the foregoing mechanisms have greatly contributed to extending the useful life of printer ribbon cartridges, they are not entirely satisfactory. Specifically, there exists a need for a printer ribbon cartridge comprising an internal re-inking mechanism that extends ribbon life, decreases cost and ink waste, and eliminates the need for disassembly, removal or manually replenishing the ink supply. The present invention is directed to providing such a printer ribbon cartridge.

SUMMARY OF THE INVENTION

In accordance with the present invention, a printer ribbon cartridge containing an internal mechanism for re-inking the ribbon housed in the cartridge is provided. The internal re-inking mechanism comprises a drive assembly, pump, a mechanism for coupling the drive assembly to the pump, an ink reservoir, an ink feeding conduit, a re-inking ring and a transfer roller. As the ribbon is threaded and propelled through the drive assembly, the pump supplies ink to the re-inking ring, which in turn supplies ink to the ribbon in the transfer roller.

In accordance with other aspects of the present invention, the rotation of the drive propels the ribbon between through the cartridge. As the ribbon is moved by the drive assembly, the drive assembly also drives the pump. Hence, movement of the ribbon meters the ink supplied to the re-inking ring.

In accordance with further aspects of this invention, the mechanism for coupling the drive assembly to the pump includes an eccentric and a drive belt. Preferably, the eccentric is connected to the drive spindle by the drive belt. The drive assembly rotates the drive belt and the eccentric. Rotation of the eccentric causes translation of a shaft that drives the pump. The pump pumps ink from the ink reservoir through the ink feeding conduit. The ink feeding conduit deposits the ink into a re-inking ring.

In accordance with alternative aspects of this invention, the ink feeding conduit deposits ink directly into an ink transfer reservoir located within the re-inking ring. The ink is transferred from the ink transfer reservoir into the re-inking ring through a plurality of ducts in the ink transfer reservoir. The ink is finally transferred from the re-inking ring to the ribbon by the ink transfer roller.

As will be readily appreciated from the foregoing summary, the invention provides a new and improved printer ribbon cartridge that overcomes many of the disadvantages of prior printer ribbon cartridges described above.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
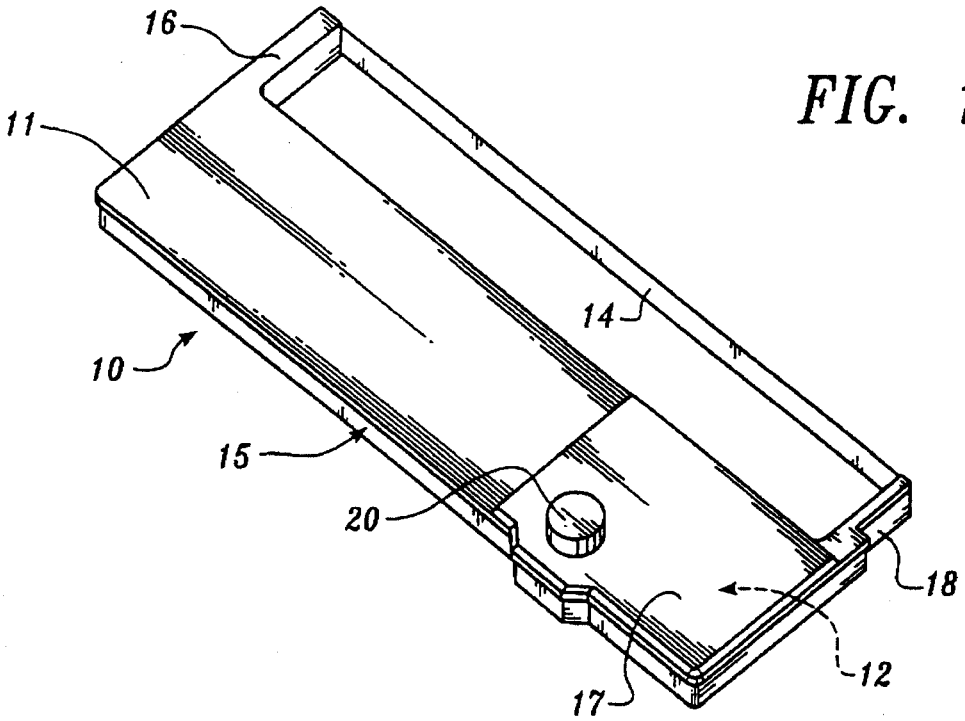
FIG. 1 is an isometric view of a printer cartridge including an internal re-inking mechanism formed in accordance with the present invention.

Many configurations of printer cartridges for computer printers, typewriters, word processors, and the like well known in the prior art can employ the improvement of the present invention. A preferred embodiment of a computer printer cartridge 10 containing an internal re-inking mechanism 12 formed in accordance with the present invention is shown in FIG. 1. The printer cartridge 10 comprises a body 15, a first ribbon arm 16 and a second ribbon arm 18. The majority of the ribbon 14, which forms a continuous loop, is stored within the body 15. While ribbon height remains constant, the internal re-inking mechanism 12 of the present invention requires an increase in housing height. Therefore, an upper surface 11 of the body 15 adjacent to the second arm 18 is slightly raised to form a plateau 17. In operation, the stored ribbon is continuously withdrawn from the body through the first arm 16 and returned to the second arm 18 by a drive assembly that is described below. As a result, the exposed length of the ribbon between the arms continuously changes. A knob 20, mounted on the spindle of the drive roller of the hereinafter described drive assembly, is located atop the plateau 17, and is used to adjust ribbon tension and eliminate slack in the ribbon. In the preferred embodiment, the ribbon 14 is made of a woven nylon cloth well known in the printer cartridge industry. Re-inking such ribbon allows the ribbon to continue producing acceptable print at a density greater than 0.50 O.D.U. (minimum acceptable density) for a longer period of time, thus, extending ribbon life.

Figure 2:
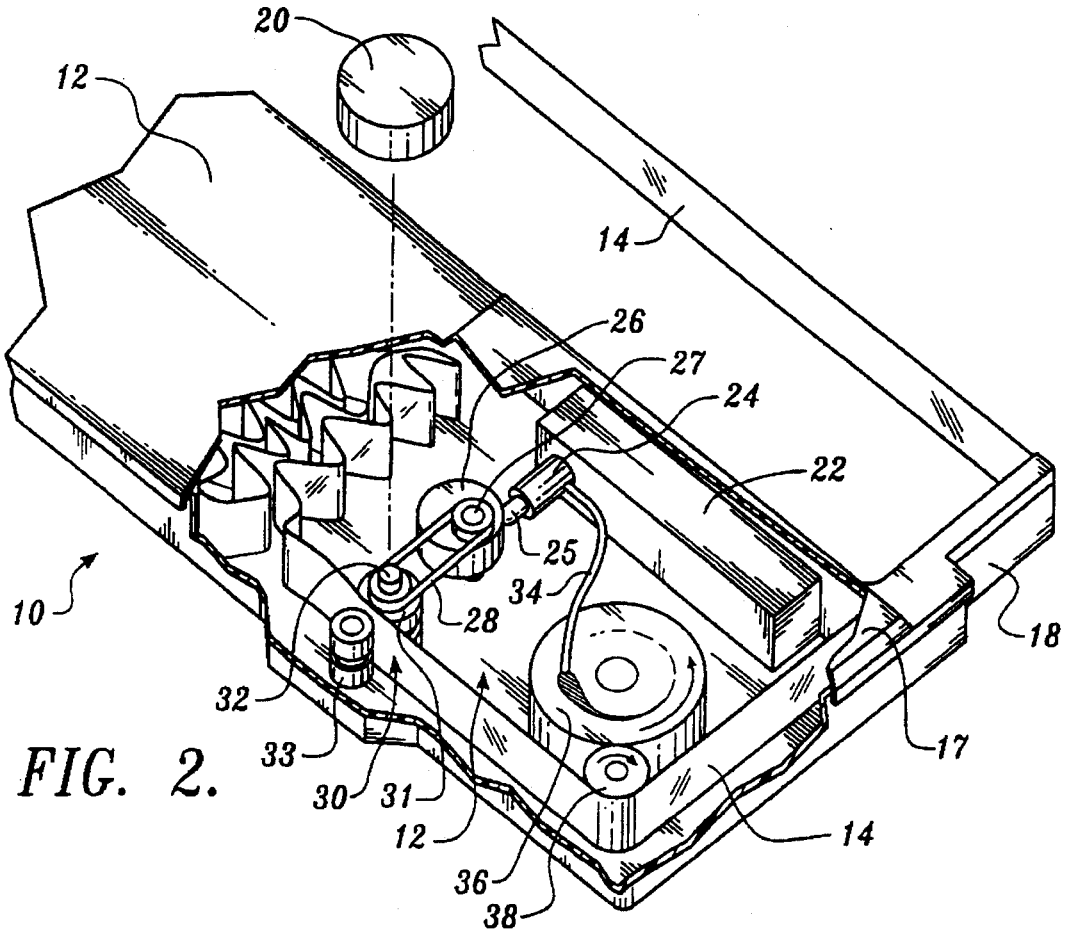
FIG. 2 is a cut-away view showing the internal re-inking mechanism of the present invention encased in the printer cartridge of FIG. 1.

FIG. 2 is a cut-away view of the internal re-inking mechanism 12 of the present invention encased by the primer cartridge 10. In operation, excess ribbon 14 becomes fan-folded as it is stuffed within the body 15 of the primer cartridge. The ribbon is withdrawn from the first arm 16 and pulled into the second arm 18 by a drive assembly 30 through which the ribbon is threaded.

The drive assembly 30 comprises a drive roller 31 and a cooperating pinch roller 33. The ribbon 14 passes between the drive roller 31 and the pinch roller 33. The drive roller 31 is mounted upon a drive spindle 32. When the printer cartridge 10 is mounted in a dot-matrix computer primer (not shown), the drive spindle 32 is coupled to a drive mechanism that rotates the drive spindle in a clockwise direction, as shown in FIG. 1. As the drive spindle rotates, the drive roller 31 is rotated in a clockwise direction. As the drive roller 31 rotates in a clockwise direction, the pinch roller 33 rotates in a counterclockwise direction, propelling the ribbon through the rollers. As a result, ribbon is pulled from the second arm 18 and stuffed into cartridge body 15.

The knob 20 is mounted on the upper end of the drive spindle 32. Consequently, turning the knob 20 rotates the drive roller 31 and the pinch roller 33 of the drive assembly 30, pulls the ribbon from the second ann 18, and stuffs the ribbon into the body 15. Hence, the knob can be used to eliminate slack and adjust the tension of the ribbon.

Rotation of the drive assembly 30 also drives a spring-loaded pump 24. The pump supplies ink to the ribbon 14. The preferred mechanism for coupling the drive assembly 30 to the spring loaded pump includes an eccentric and a drive belt. The eccentric 26 includes a spindle 27. The drive belt 28 connects the drive spindle 32 to the eccentric spindle 27. The eccentric impinges on the end of a shaft 25 that forms part of and operates the pump 24. In operation, the clockwise rotation of the drive spindle 32 causes clockwise rotation of the drive belt 28 and, thus, the eccentric spindle 27. Rotation of the eccentric spindle 27 causes translation of the shaft 25 which, in turn, causes the spring-loaded pump 24 to pump ink from a reservoir 22. Although a spring-loaded pump is used in the preferred embodiment, it will be appreciated by those skilled in the art that various types of pumps may be used, e.g., a pump wherein power is used to move the pump element out as well as in. Further, it will be appreciated that coupling mechanisms other than eccentric/drive belt mechanisms can be used; for example, a gear drive mechanism.

The inlet of the pump 24 is connected to an ink reservoir 22 and the outlet is connected to an ink feeding tube 34. The reservoir 22 stores a large quantity of ink for re-inking the ribbon 14. The pump 24, as driven by the drive assembly 30 via the eccentric 26, pumps the ink from the reservoir 22 to the ink feeding tube 34. The ink feeding tube deposits the ink it carries directly into a re-inking ring 36. The re-inking ring is formed of a material that makes it capable of absorbing and holding the ink deposited by the ink feeding tube. It will be appreciated by those skilled in the art that the re-inking ring may be made from a variety of substances, such as certain forms of plastics, rubber or cellulose, that have sponge-like or porous qualities. In one actual embodiment of the invention, the re-inking ring 36 is made of foam. The pump 24 continues to pump ink into the ink ring 36 until the ink supply in reservoir 22 runs dry, thus ensuring that all of the ink stored in the reservoir is used. Consequently, the print density level of the ribbon 14 will remain above the minimum acceptable density of 0.50 O.D.U. until the ink supply in reservoir 22 runs dry. In fact, print density will remain at near new ribbon levels until all of the ink is used. In addition, larger quantities of ink may be stored in the printer ribbon cartridge when disbursement of the ink is moderated by use of a pump, when compared to printer ribbon cartridges wherein ink is solely stored in a porous ring. Since the reservoir 22 is internal and contains large quantities of ink, in most embodiments of the invention, disassembly of the printer cartridge 10 and manually replenishing the supply of ink will not be necessary. However, it may be desirable to modify the illustrated embodiment of the invention to allow this in some cartridges. That is, depending upon the usable life of the ribbon 14, it is to be understood that all or part of the re-inking mechanism, such as the reservoir, pump and feeding tube, could be replaceable.

Ink is transferred from the re-inking ring 36 to the ribbon 14 via a transfer roller 38 as the ribbon is pulled from the second ribbon arm 18 by the drive assembly 30. The ribbon engages the transfer roller 38 and rotates the transfer roller in a clockwise direction as the ribbon is pulled from the second ribbon arm. Since the transfer roller is in frictional engagement with the re-inking ring, the re-inking ring rotates in a counterclockwise direction. As the re-inking ring rotates, ink is deposited in the re-inking ring along a circular path ensuring uniform distribution of ink throughout the re-inking ring. In addition, as the re-inking ring engages the transfer roller, the ink is transferred from the re-inking ring to the transfer roller. Finally, the transfer roller transfers the ink to the ribbon as the ribbon is pulled through the second arm 18 and engages the transfer roller.

Figure 3:
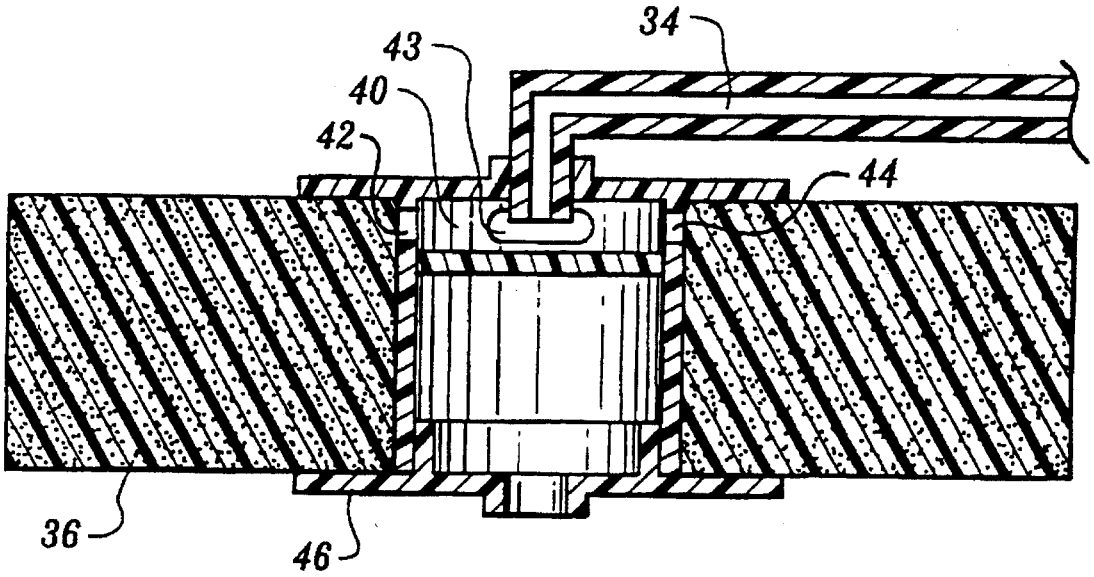
FIG. 3 is a cross-sectional view of an alternate embodiment of a re-inking ring employed by the internal re-inking mechanism of the present invention.

FIG. 3 shows an alternate embodiment of the re-inking ring of the present invention. In this embodiment, the re-inking ring 36 is mounted on a hub 46 that is rotatably mounted in the housing 12. The hub 46 is molded to form an ink transfer reservoir 40 located within the re-inking ring at the top, center of the hub. The ink transfer reservoir 40 includes a plurality of ink transfer ducts 42, 43 and 44 located about the circumferential periphery of the reservoir. The ink feeding tube 34 transfers ink from the ink reservoir 22 and into the center of the transfer reservoir 40. As shown, the feeding transfer tube forms one of the shafts about which the hub 46 rotates. The other shaft is not shown.

Ink deposited in the transfer reservoir 40 seeps through the ink transfer ducts 42, 43 and 44 into the porous re-inking ring 36 that surrounds the hub 46. The transfer reservoir 40 and the ink transfer ducts ensure quick and uniform disbursement of ink throughout the ink ring 36 because the ink spreads uniformly from the center of the re-inking ring to the outside of the re-inking ring. In addition, depositing the ink directly into the transfer reservoir as opposed to depositing the ink into the re-inking ring as it rotates, reduces ink waste.

While preferred embodiments of the present invention have been illustrated and described, it will be appreciated that various changes can be made therein without departing from the spirit and scope of the invention. Accordingly, it is not intended that the scope of the invention be limited by the disclosure of the preferred embodiments, instead the invention should be determined entirely by reference to the claims that follow.

The embodiments of the invention in which an exclusive property or privilege is claimed are defined as follows:

1. In a printer ribbon cartridge housing a ribbon, wherein the printer ribbon cartridge includes a body having a first ribbon arm, a second ribbon arm and a drive assembly for moving the ribbon through the body, the improvement comprising an internal re-inking mechanism encased within the body for re-inking the ribbon, the internal re-inking mechanism having:

(a) a pump having an inlet and an outlet, the pump mounted within the body of the printer cartridge and driven by the drive assembly of the printer cartridge which moves the ribbon through the body;

(b) an ink reservoir coupled to the inlet of the pump so that the pump draws ink from the ink supply;

(c) an ink feeding conduit coupled to the outlet of the pump;

(d) a re-inking ring rotatably mounted in the body for receiving ink from said ink feeding conduit; and (e) a transfer roller rotatably mounted to the body in frictional engagement with both the re-inking ring and the ribbon for transferring ink from the re-inking ring to the ribbon.

2. The improvement of claim 1 further comprising a coupling mechanism connecting the drive assembly to the pump.

3. The improvement of claim 2, wherein the coupling mechanism further comprises an eccentric and a drive belt, the eccentric connected to the drive assembly by the drive belt.

4. The improvement of claim 3, wherein the pump includes a shaft whose longitudinal movement causes the operation of the pump and wherein, as the drive assembly rotates, the drive belt causes the eccentric to rotate and longitudinally translate the shaft of the pump.

5. The improvement of claim 1, wherein the re-inking ring further comprising an ink transfer reservoir for receiving ink from said ink feeding conduit.

6. The improvement of claim 5, wherein the ink transfer reservoir further comprising a plurality of ducts through which ink is transferred to the re-inking ring.

7. The improvement of claim 1, further comprising a hub rotatably mounted in the body of the printer cartridge, wherein the re-inking ring is mounted on the hub so as to surround the hub.

8. The improvement of claim 7, wherein the hub is molded to form an ink transfer reservoir having a plurality of ducts through which ink is transferred to the re-inking ring.

9. The improvement of claim 1, wherein the re-inking ring is made of an absorbent material capable of absorbing and holding ink.

10. In a printer ribbon cartridge housing a ribbon and including a first ribbon arm, a second ribbon arm, a body and a drive assembly through which the ribbon is threaded, the improvement comprising an internal re-inking mechanism for re-inking the ribbon, the re-inking mechanism including:

(a) a pump mounted within the body, the pump being driven by the drive assembly and having an inlet and an outlet;

a coupling mechanism for connecting the drive assembly to the pump;

(c) an ink supply connected to the inlet of the pump so that the pump draws ink from the ink supply;

(d) an ink feeding conduit connected to the outlet of the pump through which the pump pumps ink drawn from the ink supply;

(e) a re-inking ring rotatably mounted to the body for receiving ink from the ink feeding conduit; and (f) a transfer roller rotatably mounted to the body in frictional engagement with the re-inking ring for transferring ink from the re-inking ring to the transfer roller as the transfer roller rotates.

11. The improvement of claim 10, wherein the transfer roller is rotatably mounted to the body in frictional engagement with the ribbon so that ink is transferred from the transfer roller to the ribbon as the ribbon is stuffed into the cartridge.

12. The improvement of claim 10, wherein the coupling mechanism comprises an eccentric and a drive belt.

13. The improvement of claim 12, wherein the pump has a shaft whose longitudinal translation causes the pump to pump ink received at the inlet of the pump and wherein the eccentric is coupled to the end of the shaft such that as the drive assembly moves the drive belt and causes the eccentric to rotate the eccentric causes translation of the pump shaft of the pump.

14. The improvement of claim 10, wherein the re-inking ring is rotatably mounted to the printer cartridge by a hub.

15. The improvement of claim 14, wherein the hub is molded to form an ink transfer reservoir having a plurality of ducts through which the ink is transferred to the re-inking ring.

16. The improvement of claim 10, wherein the re-inking ring is made of an absorbent material capable of absorbing and holding ink.

* * * * *

UNITED STATES PATENT AND TRADEMARK OFFICE

CERTIFICATE OF CORRECTION

PATENT NO. : 5,511,888

DATED : April 30, 1996

INVENTOR(S) : G.W. Beach

It is certified that error appears in the above-indentified patent and that said Letters Patent is hereby corrected as shown below:

| COLUMN | LINE | |
|---|---|---|
| On title page, item [56] | Refs. Cited U.S. Pat. Docs. | Insert --3,983,837 10/05/1976 Francis-- |
| [56] | Refs. Cited U.S. Pat. Docs. | Insert --5,314,257 05/24/1994 Cheng-- |
| [56] | Refs. Cited For. Pat. Docs. | Insert --58 49292 03/23/1983 Japan Abstract Only-- |
| [56] | Refs. Cited For. Pat. Docs. | Insert --WO 92/12015 07/23/1992 PCT-- |
| [56] | Refs. Cited For. Pat. Docs. | Insert --EP 0 564 649 A1 10/13/1993 EPC-- |

UNITED STATES PATENT AND TRADEMARK OFFICE

CERTIFICATE OF CORRECTION

PATENT NO. : 5,511,888

DATED : April 30, 1996

INVENTOR(S) : G.W. Beach

It is certified that error appears in the above-indentified patent and that said Letters Patent is hereby corrected as shown below:

| COLUMN | LINE | |
|---|---|---|
| 6 (Claim 5, | 2 line 2) | "comprising" should read --comprises-- |
| 6 (Claim 6, | 5 line 2) | "comprising" should read --comprises-- |
| 6 (Claim 10, | 27 line 9) | Before "a" insert --(b)-- |

Signed and Sealed this

Twelfth Day of November, 1996

*Attest:*

Bruce Lehman

BRUCE LEHMAN

*Attesting Officer*

*Commissioner of Patents and Trademarks*